US011859842B2

(12) United States Patent
Abate et al.

(10) Patent No.: US 11,859,842 B2
(45) Date of Patent: Jan. 2, 2024

(54) INDOOR AIR QUALITY PURIFICATION SYSTEM FOR A HEATING, VENTILATION AND COOLING SYSTEM OF A BUILDING

(71) Applicant: Clean Air Group, Inc., Fairfield, CT (US)

(72) Inventors: Anthony M. Abate, Seymour, CT (US); Hal Ross Gurman, Scottsdale, AZ (US); Dhirenda Damji, Niskayuna, NY (US)

(73) Assignee: CLEAN AIR GROUP, INC, Fairfiled, CT (US)

( * ) Notice: Subject to any disclaimer, the term of this patent is extended or adjusted under 35 U.S.C. 154(b) by 0 days.

(21) Appl. No.: 17/627,725

(22) PCT Filed: Jul. 15, 2020

(86) PCT No.: PCT/US2020/042032

§ 371 (c)(1),
(2) Date: Jan. 17, 2022

(87) PCT Pub. No.: WO2021/011589

PCT Pub. Date: Jan. 21, 2021

(65) Prior Publication Data

US 2022/0260270 A1 Aug. 18, 2022

Related U.S. Application Data

(60) Provisional application No. 62/875,666, filed on Jul. 18, 2019.

(51) Int. Cl.
*F24F 11/52* (2018.01)
*F24F 110/70* (2018.01)
(Continued)

(52) U.S. Cl.
CPC ..... *F24F 11/52* (2018.01); *F24F 2110/66* (2018.01); *F24F 2110/70* (2018.01); *F24F 2110/72* (2018.01)

(58) Field of Classification Search
CPC ..... F24F 11/52
See application file for complete search history.

(56) References Cited

U.S. PATENT DOCUMENTS 3,514,997 A 6/1970 Gwathmey
4,547,079 A 10/1985 Alamprese
(Continued)

FOREIGN PATENT DOCUMENTS

EP 1635151 A 6/2005
WO 2018/132892 A 7/2018

OTHER PUBLICATIONS

International Search Report for PCT/US20/42032, dated Oct. 16, 2020 (2 pages).

*Primary Examiner* — Nathan L Laughlin
(74) *Attorney, Agent, or Firm* — AMSTER, ROTHSTEIN & EBENSTEIN LLP

(57) ABSTRACT

An indoor air purification system installed in a heating, ventilation and cooling (HVAC) system of a residential or commercial building. The air purification system includes an indoor air quality (IAQ) monitor mounted in a return duct of the HVAC system to detect various undesirable gases, as well as climatic conditions, and controls a bi-polar ionization unit to help alleviate undesirable air quality issues that can be considered health risks at excessive levels. The IAQ monitor communicates electronically with the ionization unit and with a building HVAC automation system via wireless and/or wired electronic communication networks.
(Continued)

The building HVAC automation system can utilize data from the IAQ monitor to control some HVAC functions to optimize HVAC efficiency.

18 Claims, 10 Drawing Sheets

(51) Int. Cl.
*F24F 110/72* (2018.01)
*F24F 110/66* (2018.01)

(56) References Cited

U.S. PATENT DOCUMENTS

| | | | | |
|---|---|---|---|---|
| 6,834,529 | B2 | 12/2004 | Head | |
| 8,024,986 | B2 | 9/2011 | Pettit | |
| 8,147,302 | B2 | 4/2012 | Desrochers | |
| 8,578,790 | B2 | 11/2013 | Secor | |
| 9,032,780 | B2 | 5/2015 | Anderson | |
| 2007/0137318 | A1 | 6/2007 | Desrochers | |
| 2010/0144261 | A1* | 6/2010 | Barkic | B60H 1/00792 454/75 |
| 2016/0116181 | A1* | 4/2016 | Aultman | F24F 11/62 700/276 |
| 2019/0309972 | A1* | 10/2019 | Roen | C02F 1/008 |
| 2020/0033017 | A1* | 1/2020 | Brown | G01N 33/0009 |
| 2020/0264088 | A1* | 8/2020 | Bentley | G01N 15/06 |
| 2021/0381933 | A1* | 12/2021 | Schmandt | G01N 1/2247 |

* cited by examiner

INDOOR AIR QUALITY PURIFICATION SYSTEM FOR A HEATING, VENTILATION AND COOLING SYSTEM OF A BUILDING

BACKGROUND OF THE INVENTION

1. Field of the Invention

The present invention relates generally to an indoor air quality purification system monitors, and more specifically to an indoor air quality monitor illustratively for use in a heating, ventilation and cooling system to monitor for contaminants in the air passing through a return duct or an air handler.

2. Description of the Related Art

Indoor air environments frequently include suspended particulates, such as dust, dander, soot and smoke particles, pollen, mold, bacteria, and viruses. Indoor gases are also present, being released from building materials, furnishings and nondurable goods. In office environments, the greater use of machines, such as photocopying equipment and the like, is especially problematic, as this equipment may emit volatile organic compounds.

These particulates can degrade the quality of the air, making it less pleasant and even dangerous to occupants of the space. Modern construction techniques that promote energy efficiency, such as insulating walls, ceilings, doors and windows, and wrapping buildings with air intrusion barriers, have created spaces that are so airtight that the buildings are unable to off-gas toxic elements.

In ordinary heating, ventilation and cooling (HVAC) systems, air is drawn through a filter, which is intended to trap particulates in the filter. However, traditional filters are only effective for large particles of at least 10 microns in size. While high efficiency particle air (HEPA) filters are more effective, they also have disadvantages, as they may quickly become clogged, requiring frequent changing to avoid overburdening the HVAC equipment. Because of the presence of contaminants in the air and the general inability of physical filters to remove the same, a condition known as "sick building syndrome" has developed. Various building codes designed to mitigate this syndrome have been introduced; for example, the American Society of Heating, Refrigeration & Air Conditioning Engineers (ASHRAE) recommends a minimum of 8.4 air exchanges in a 24-hour period (a 35% hourly turnover rate). While commercial and industrial facilities generally meet that minimum level, their air quality may remain inferior. While a greater turnover rate would increase the interior air quality, it would also reduce a building's energy efficiency.

An alternative method to filtering involves the use of ion exchange technology to remove contaminants from air. An electrically neutral atom or molecule has an equal number of electrons and protons. Ionization occurs where an atom or molecule loses or gains one or more electrons. If an electron bound to an atom or molecule absorbs enough energy from an external source, it may exceed the ionization potential and allow the electron to escape its atomic orbital. When this occurs, the electron is lost, and an ion with a positive electrical charge, a cation, is produced. Electrons that are lost become free electrons. When a free electron later collides with an atom, it may be captured within an orbital. The gain of an electron by an atom or molecule creates an ion with a negative electrical charge, an anion.

The ionization of air, e.g., air in the Earth's atmosphere, results in the ionization of the air's constituent molecules, primarily oxygen and nitrogen. While the nitrogen in air is more plentiful than oxygen, oxygen is more reactive. Thus, oxygen has a lower ionization potential than nitrogen, allowing for oxygen cations to be formed with greater ease than nitrogen cations, and oxygen has a higher electro-negativity than nitrogen, allowing for oxygen anions to be formed with greater ease than nitrogen anions.

Ionization is known to break down organic chemicals into the basic molecular constituents of water, carbon dioxide, and related metal oxides. Thus, ionization has potential for cleaning indoor air, by eliminating organic molecules and their associated odors from the enclosed environment. Ionization also contributes to the reduction of inorganic pollutants, by imparting a charge to those molecules, which clump together and then drop out of the air.

Studies indicate that positive ions (cations) may impair human health in a number of ways, such as by stimulating increased production of the neurohormone serotonin, which may lead to exhaustion, anxiety and depression. Positive ions are frequently found in offices where visual display units (VDUs) are used. Negative ions (anions) have a calming effect. Thus, a machine that cleans indoor air should seek to introduce negative ions into the airstream.

Various commercial products have been made including machines that incorporate bi-polar ionization tubes. The ionization of air may also produce ozone, $O_3$, which is not desirable. Therefore, there is demand for a system which provides a sufficient level of ionization to effectively address the contaminants in an airstream, while minimizing the production of ozone.

It has become highly desirable to use ion exchange technology for air treatment, and indeed there are many suppliers of bi-polar ionization tubes that are stand-alone devices used in specified locations, or centralized installations which are integrated into a building HVAC system. These devices are used in a way so that air circulated into and recirculated within the building can pass over the bi-polar emitting devices, which generally take the form of an ionization tube or tubes. This accomplishes the goal of improving air quality without mandating greater air exchange rates. Thus, an additional benefit of ionization treatment of indoor air is that it contributes to the efficiency of HVAC operations.

Indoor air quality (IAQ) detectors/monitors and controllers are installed in the HVAC ductwork to help automate the ionization process therein, whereby detection of undesirable levels of contaminants and/or noxious gases will trigger the activation of one or more ionizers which help reduce the air contamination levels in a well-known manner. The IAQ detectors can include various gas, particulate matter and climatic sensors, upon which a predetermined threshold being exceeded will trigger an alarm signal to be sent to a controller as an early warning system. Similarly, the IAQ detectors can also include a sensor for detecting increased levels in ozone produced by the ionizer(s), which upon reaching a predetermined level, will send a signal to a controller to terminate the ionizing process.

Most commercial building codes require the IAQ detector to be mounted within the return ducts or air handlers of an HVAC system. The current IAQ detectors are positioned so that the air flow in the duct passes over the various sensors. Accordingly, most of the various gas sensors are mounted on or flush with the outer surface of the IAQ detector housing. The various sensors can include, for example, a carbon monoxide (CO) sensor, a carbon dioxide ($CO_2$) sensor, a total volatile organic compound (TVOC) sensor, a formaldehyde ($CH_2O$) sensor, an ozone ($O_3$) sensor, a particulate matter (PM) sensor, as well as a temperature and relative humidity (RH) sensor.

It has been found that the IAQ detector housing can impede the air flow in the duct and create undesirable airflow disturbances (e.g., vortexes), which can lead to noise and pressure drops. As well, the placement of the sensors on the housing has also led to improper gas monitoring and increased maintenance of the IAQ detector. In particular, the high sensitivity requirements of some of the various gas sensors and the positioning of the sensors on or adjacent to the outer surface of the IAQ detector housing, e.g., at the front and/or sides of the housing, has made the sensors more susceptible to the pollutants in the air flow, which diminishes the sensors detection capabilities over time. Accordingly, frequent maintenance, such as cleaning or replacement of the IAQ detectors is often required.

Therefore, there is a need in the art for an improved, more efficient IAQ detector which is less susceptible to air pollutants and contaminants normally found in the ducts of HVAC systems or stand-alone devices.

BRIEF DESCRIPTION OF THE DRAWINGS

Further advantages and features of the present invention will become apparent from the detailed description of a preferred embodiment of the invention with reference to the accompanying drawings, in which.

Figure 1:
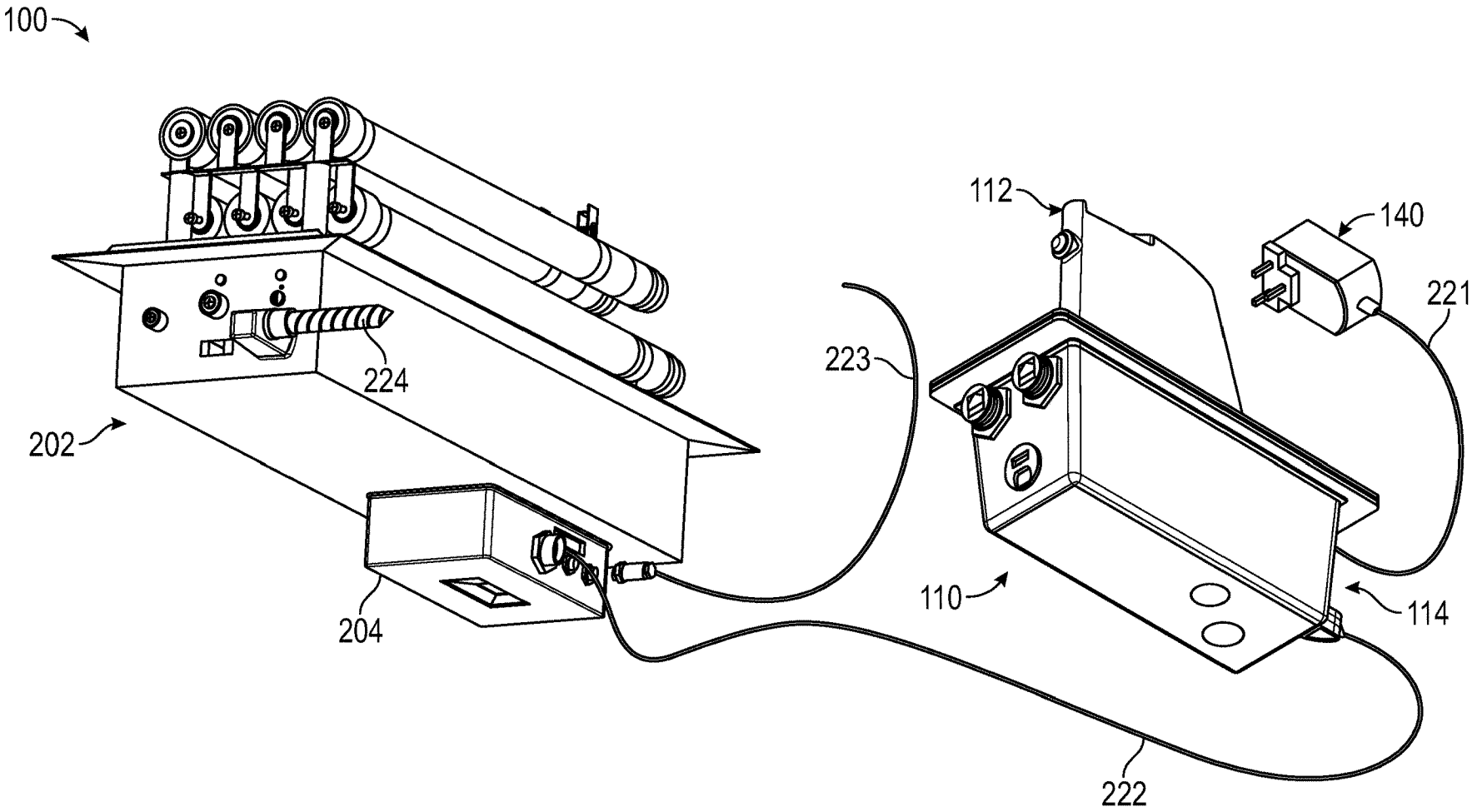
FIG. 1 depicts an illustrative air ionization purification system having a bi-polar ionization tube that is controlled in part by an indoor air quality (IAQ) monitor of the present invention and which is suitable for use in a heating ventilation and cooling (HVAC) system.

To facilitate understanding of the invention, identical reference numerals have been used, when appropriate, to designate the same or similar elements that are common to the figures. Further, unless stated otherwise, the drawings shown and discussed in the figures are not drawn to scale, but are shown for illustrative purposes only.

DETAILED DESCRIPTION OF THE INVENTION

Reference will now be made in detail to implementations of the invention, examples of which are illustrated in the accompanying drawings.

Referring to FIG. 1, an indoor air purification system 100 having an indoor air quality (IAQ) monitor 110 of the present invention is illustratively shown in electronic communication with a bi-polar ionization unit 202, via cable 222 and controller 204. Bi-polar ionization unit receives electrical power from cable 224, and can support other connectors, such as a two-pin aviation connector to which cable 223 is connected, for monitoring purposes.

The air purification system 100 is installed in a heat, ventilation and cooling (HVAC) system of a residential or commercial building in accordance with well-known building and HVAC standards. The indoor air purification system 100 includes an IAQ monitor 110 which is mounted in a return duct of the HVAC system to detect various undesirable gases that may be present in the air such as carbon monoxide, carbon dioxide, formaldehyde, ozone, as well as climatic conditions such as temperature and relative humidity in the HVAC system. The monitoring of the climatic conditions and the various gases by the IAQ monitor 110 provides data and electronic signals which the air purification system 100 uses to trigger and control the bi-polar ionization unit 202 to help alleviate undesirable air quality issues that can be considered health risks at excessive levels. The IAQ monitor 110 communicates electronically with the ionization unit 202 and a building HVAC automation system via wireless and/or wired electronic communication networks, for example, using a BACnet/IP protocol over a local area network (LAN) of the building. The building HVAC automation system can utilize data from the IAQ monitor 110 to control some HVAC functions to optimize HVAC efficiency. For example, by reading carbon dioxide, the HVAC system can automatically adjust outside air dampers to allow for minimal outside air and maximize efficiency. Implementing the IAQ monitor in a building HVAC air purification system, the ASHRAE 62.1 IAQ procedure can be utilized to allow for the code minimum outside air and energy savings for the building. One of ordinary skill in the art will comprehend that if the outside air is of bad quality, a user will want to minimize the intake of outside air, not only for the sake of best operating efficiency, but also to minimize any degradation of indoor air quality. This is an especially important feature in many geographic regions with cities having outside air that is orders of magnitude worse than indoor air (e.g., China, India and the like). Also the impact of air quality events like wildfires can be minimized by the sensors of the IAQ monitor constantly collecting data and making real-time adjustments to the outside air dampers and ion intensity.

Referring now to FIGS. 2-9, the IAQ monitor 110 is configured with an aerodynamic fin-shape first housing section to minimize air flow disturbances as the air flow in a duct passes over or around the IAQ monitor 110. In particular, the IAQ monitor 110 includes a housing 111 having a first housing section 112 and a second housing section 114 which collectively define an interior chamber 113 (see FIG. 9). The first housing section 112 is preferably shaped as a fin or airfoil and is configured to be inserted within the interior channel of a return or air handler duct (not shown) via a similarly dimensioned cutout or through-hole that is formed in the ductwork (e.g., a lower wall of the duct) to accommodate the fin-shaped first housing section 112. The first housing section 112 is typically inserted through the bottom wall of the ductwork, and elements will be further described as "upper" or "lower" with this typical orientation in mind. However, such orientation is not considered limiting, as the first housing section 110 can be oriented and installed in the ductwork along a sidewall or top of the rectangular shaped ductwork without diminishing the detection capabilities of the sensors therein.

The first housing section 112 includes at least one sidewall 116 that defines an interior channel 115 (see FIG. 9) which forms an upper portion of the interior chamber 113, and an air inlet port 124 for permitting duct airflow into the IAQ monitor 110. The second housing section 114 is also formed from at least one sidewall 128 to define a lower portion 117 of the interior chamber 113. The upper channel 115 and lower interior chamber 117 (see FIG. 9) collectively form the interior chamber 113 of the housing 111 through which air from the return duct flows, as discussed in further detail below with respect to FIG. 9. In one embodiment, the second housing section 114 includes a support frame or sensor mounting bridge 150 for mounting a plurality of gas and climatic sensors that detect the quality of air flow through the IAQ monitor 110. The second housing section 114 is depicted as being generally rectangular in shape, although such shape is not considered limiting, as the second housing section 114 can be square, oval, circular, curvilinear or any other shape suitable for housing the sensor mounting bridge 150, electronic circuitry, communication ports and other components necessary to detect and communicate the air quality in the ductwork.

The shape and location of the air inlet port 124 helps prevent the internal sensors from fouling more rapidly and/or drifting out of calibration quickly, as the dirt-laden air doesn't enter directly into the interior of the IAQ monitor 110. The sampling port is positioned to face downstream of the air flow, and due to the inlet metering fan's constant and calculated sampling rate, the ram-air effect is minimized. This stabilizes the sampling rate to always match the algorithms, enhancing accuracy. Furthermore, by having the sampling port facing downstream, debris that may be entrained in the airflow is prevented substantially blocking the cross-sectional area of the sampling port. The fin or airfoil shape assists this diversion process. The shape and location of the air inlet port 124 is designed such that the sampling rate of the metering fan should be relatively constant, despite the fact that, as is known to one of ordinary skill in the art, air handler speed and air flow can vary for many reasons, and change frequently. The constant and repeatable sampling rate enhances accuracy, longevity and repeatability of data collected over long periods of time.

Figure 2:
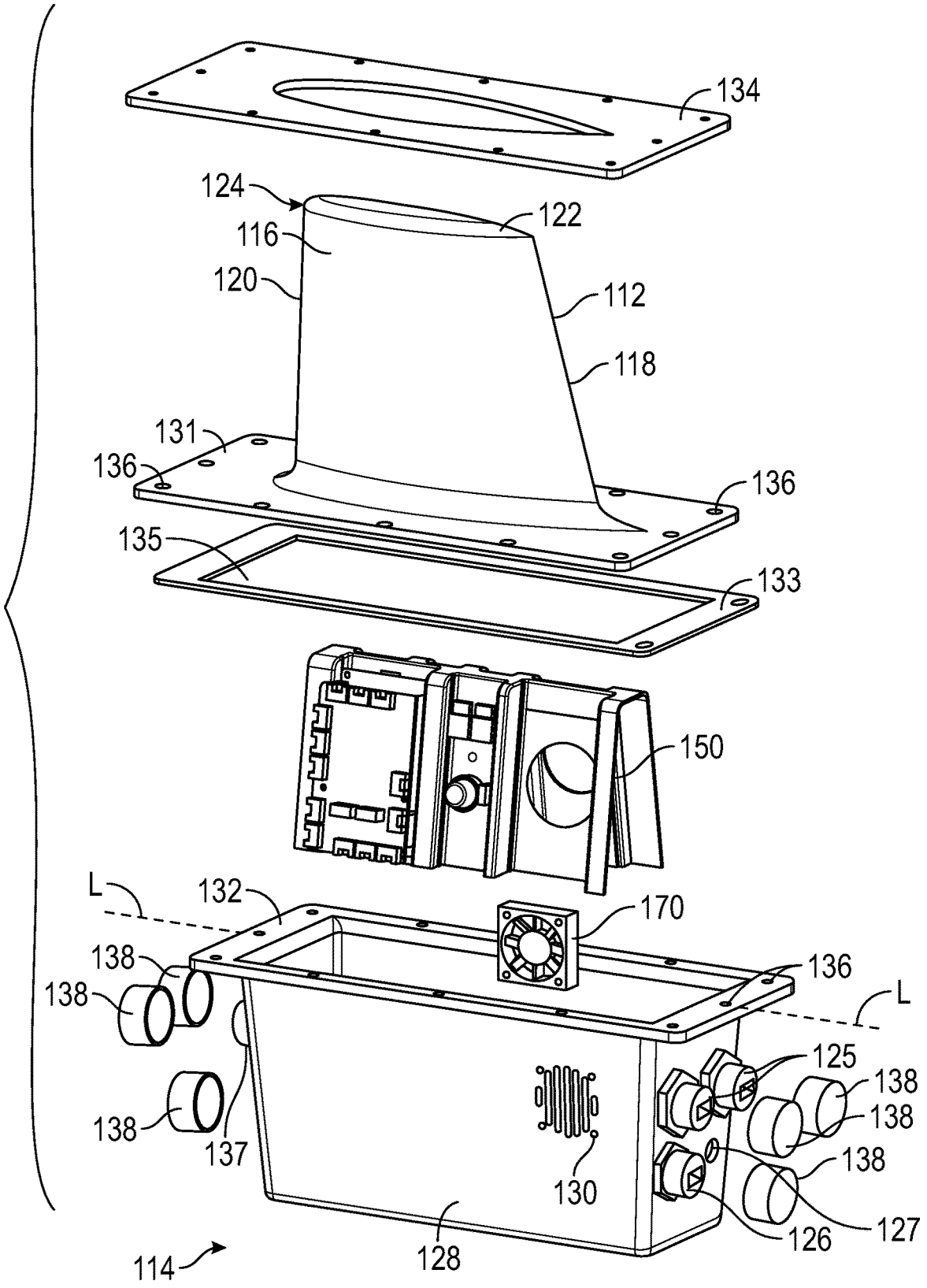
FIG. 2 is an exploded top, front, left-side perspective view of the IAQ monitor of FIG. 1.
Figure 6:
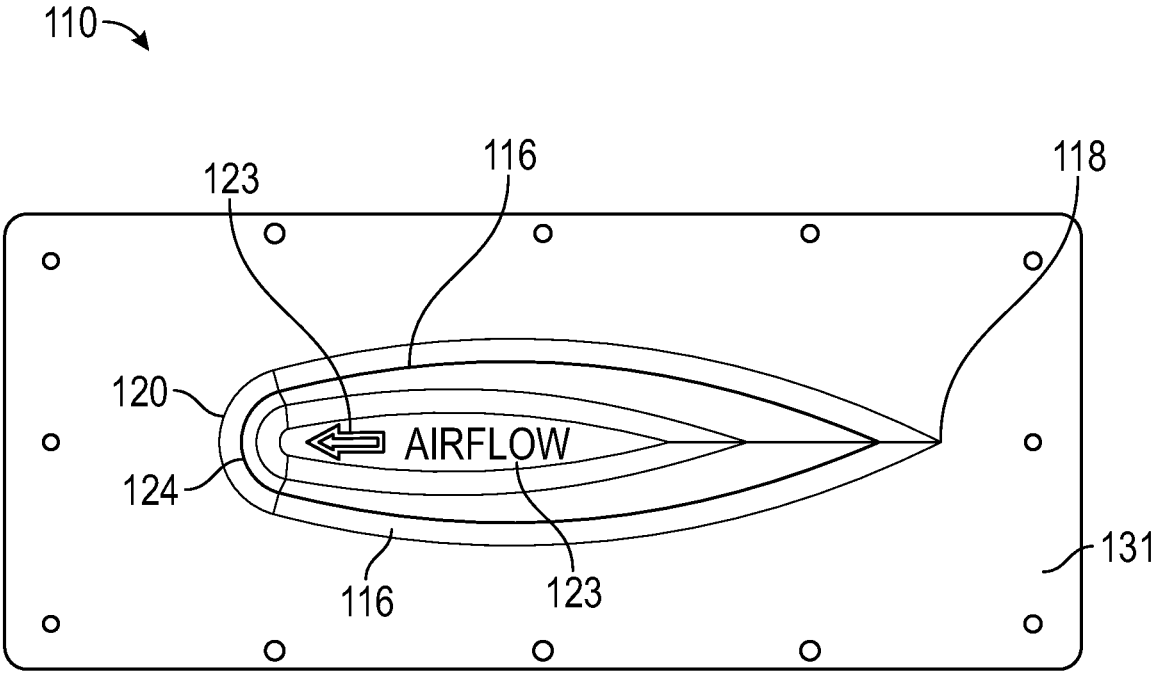
FIG. 6 is a top view of the IAQ monitor housing of FIG. 2.

Referring to FIGS. 2 and 6, the first housing section 112 includes a top 122 and an open bottom portion. The second housing section 114 includes a bottom wall 129 and an open top portion. A first outwardly extending flange 131 circumscribes the open bottom portion of the first housing section 112, and a second outwardly extending flange 132 circumscribes the open top portion of the second housing section 114. The outwardly extending flanges 131 and 132 are sized and dimensioned to conform in shape for attachment to each other after the sensor mounting bridge 150 and other electronic components are installed in the second housing section 114. Preferably a gasket 133 having a central opening 135 is inserted between the flanges 131 and 132 to form an airtight seal therebetween. The outwardly extending flanges 132 and 133 include a plurality of spaced apart and aligned apertures 136 for receiving a fastener (not shown) to attach the IAQ monitor 110 to the ductwork in which the first housing section 112 is inserted within the ductwork and the second housing section 114 is mounted on the exterior sidewall of the duct to orientate and secure the first housing section 112 therein. A duct sealing gasket 134 (FIG. 2) is preferably used when attaching the IAQ monitor 110 to the ductwork. The first and second housing sections 112, 114 can be fabricated from various non-porous, moisture resistant materials such as, for example, aluminum or stainless steel sheet metal, a ceramic material, polyvinylchloride or any other non-porous, water/moisture/corrosive resistant material.

Figure 4:
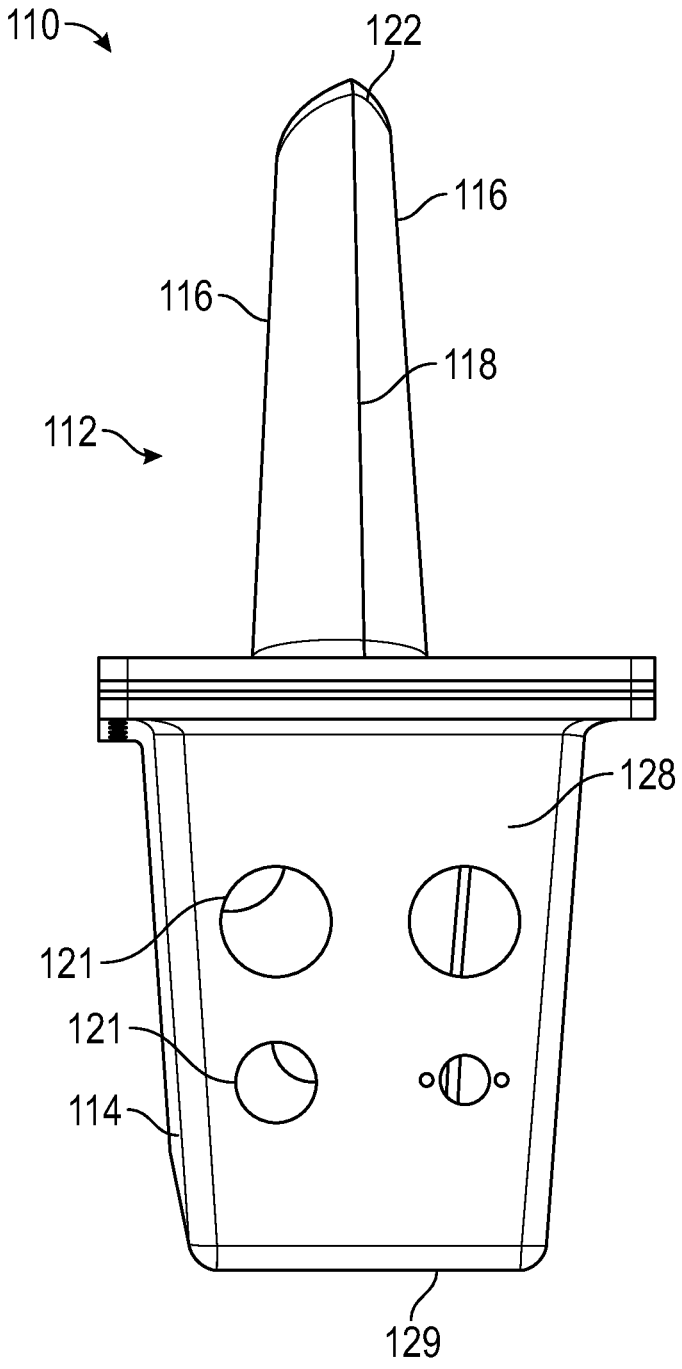
FIG. 4 is a front elevation view of the IAQ monitor housing of FIG. 2.

Referring to FIGS. 2, 4 and 6, the first housing section 112 is generally triangular or V-shaped with symmetrical lateral sidewalls 116 extending between a leading edge 118 and a trailing edge or end 120 of the first housing section 112. The leading edge 118 is configured to be positioned in a direction upstream of the airflow in the ductwork, e.g., a return duct or air handler of the HVAC system. In one embodiment, the top surface 122 includes markings 123 which indicate the direction of air flow through the ductwork. The leading edge 118 and sidewalls 116 are configured to be aerodynamic so as to minimize structural impedance of airflow by the IAQ monitor 110 within the ductwork. Preferably, the lateral sidewalls 116 are convex and symmetrical in shape with respect to a central longitudinal axis "L" of the fin-shaped first housing section 112, although the shape of the leading edge and sidewall is not considered limiting, as other shapes can be implemented (e.g., U-shaped leading edge and straight or curvilinear sidewalls, and the like).

Figure 3:
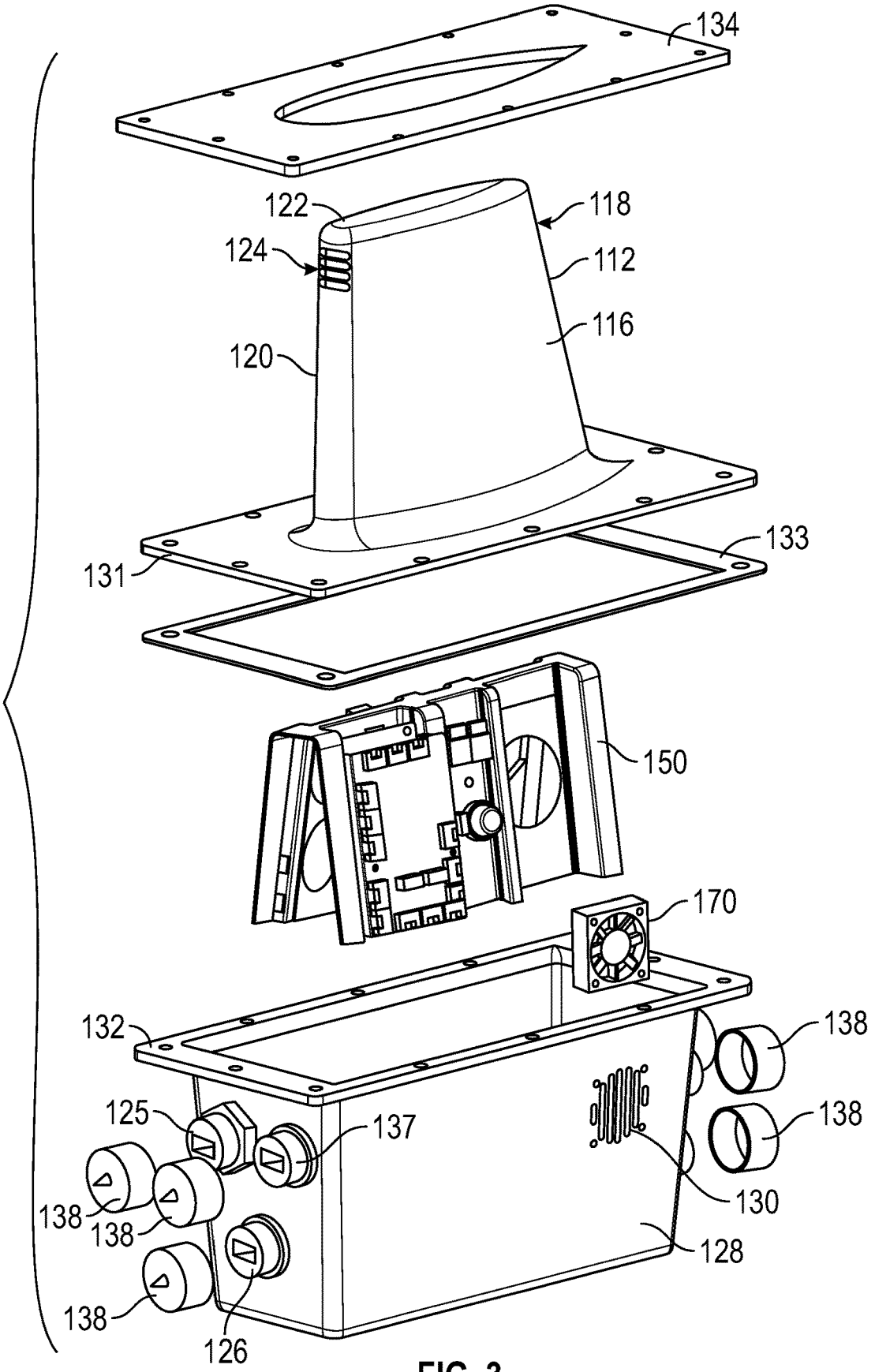
FIG. 3 is an exploded top, rear, left-side perspective view of the IAQ monitor of FIG. 2.
Figure 5:
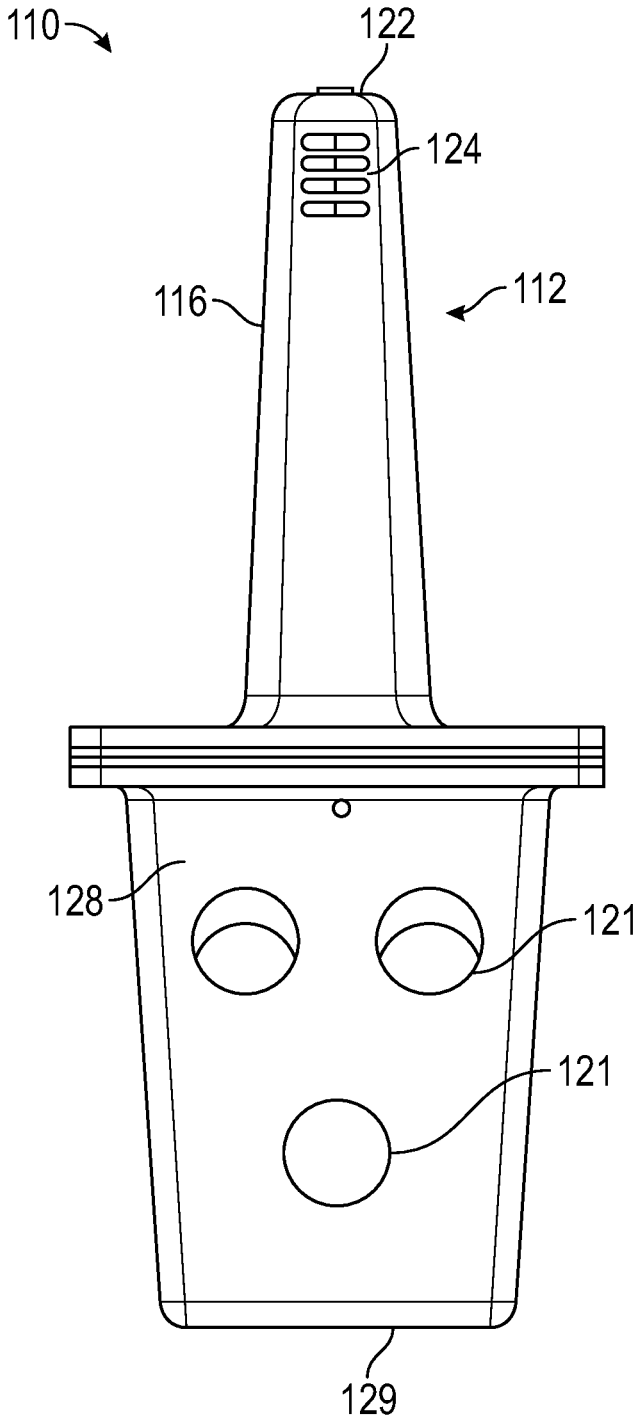
FIG. 5 is a rear elevation view of the IAQ monitor housing of FIG. 3.

Referring now to FIGS. 3, 5 and 6, a rear or trailing edge portion 120 of the first housing section 112 is preferably U-shaped, as best seen in FIGS. 1 and 6. A top portion 122 of the first housing section 112 is substantially flat, as best seen in FIG. 6. A person of ordinary skill in the art will appreciate that the U-shape trailing edge 120 and the flat top portion 122 are not considered limiting, as the trailing edge 120 can be flat or substantially flat, among other shapes, and the top portion 122 can be dome shaped, pointed or any other curvilinear shape which minimizes disturbances of airflow within the ductwork. The rear or tailing edge portion 120 includes the air inlet port 124, as best seen in FIG. 5, which is provided to receive a steady flow of the duct air at a controlled velocity so that a plurality of sensors installed within an interior chamber 113 of the second housing section 114 can sample a portion of the duct air as it passes therethrough. The sensors and electronic circuitry are housed within the interior chamber 113 of the second housing section 114 to minimize exposure to contaminants within the duct which can detrimentally affect the operability of the sensors, as discussed below in further detail.

The air inlet port 124 is preferably formed proximate the top cover 122 so as to minimize influx of heavier contaminants (e.g., dust and the like) which are more likely to be present near the interior surface or walls of the duct. For example, the interior surface of a duct can be lined with fiberglass insulation, which is prone to collect dust and particles. In some applications, the insulation lining can illustratively be two inches thick. Accordingly, the first housing section 112 and the positioning of the air inlet port 124 are at a height that extends sufficiently beyond (above) the lining to thereby minimize inflow of debris and contaminants into the interior chamber via the air inlet port 124. In one embodiment, the height of the first housing section 112 is approximately four inches, although such height is not considered limiting. The inlet port 124 can include a grill or screen to further block larger contaminants from entering the interior chamber 113.

Referring again to FIGS. 4 and 5, the second housing section 114 includes one or more openings 121 in the sidewall 128 that are sized and dimensioned to receive an input or output port or connector, such as, for example, an RJ-45 Ethernet connector 125 (FIGS. 1-3), an electrical connector 127 (FIG. 2) for receiving electrical power from an external source, a universal serial bus (USB) port 126 (FIG. 2), an HDMI connector 137 (FIG. 2) or any other well-known power/communications port suitable to indicate and/or provide power/communications to and from IAQ monitor 110. Caps 138 are provided to protect any unused connectors and ports from dust and/or moisture.

The electrical connector 127 can be connected to an external power supply 140 via cord 221, as shown. In an alternate embodiment, power supply 140 can be located inside second housing section 114.

The various input and output ports enable communications with other components of the HVAC system, such as a controller 204 illustratively mounted on the bi-polar ionization unit 202, as illustratively shown in FIG. 1. A user can optionally attach a computer monitor directly to the HDMI connector 137, to directly view the climatic and gaseous metrics being measured by IAQ monitor 110. Although the controller 204 is illustratively shown mounted to the ionization device 202, such location is not considered limiting as a person of ordinary skill in the art will appreciate that the controller 204 can be locally or remotely located from either the ionization unit 202 or the IAQ monitor 110.

Figure 7:
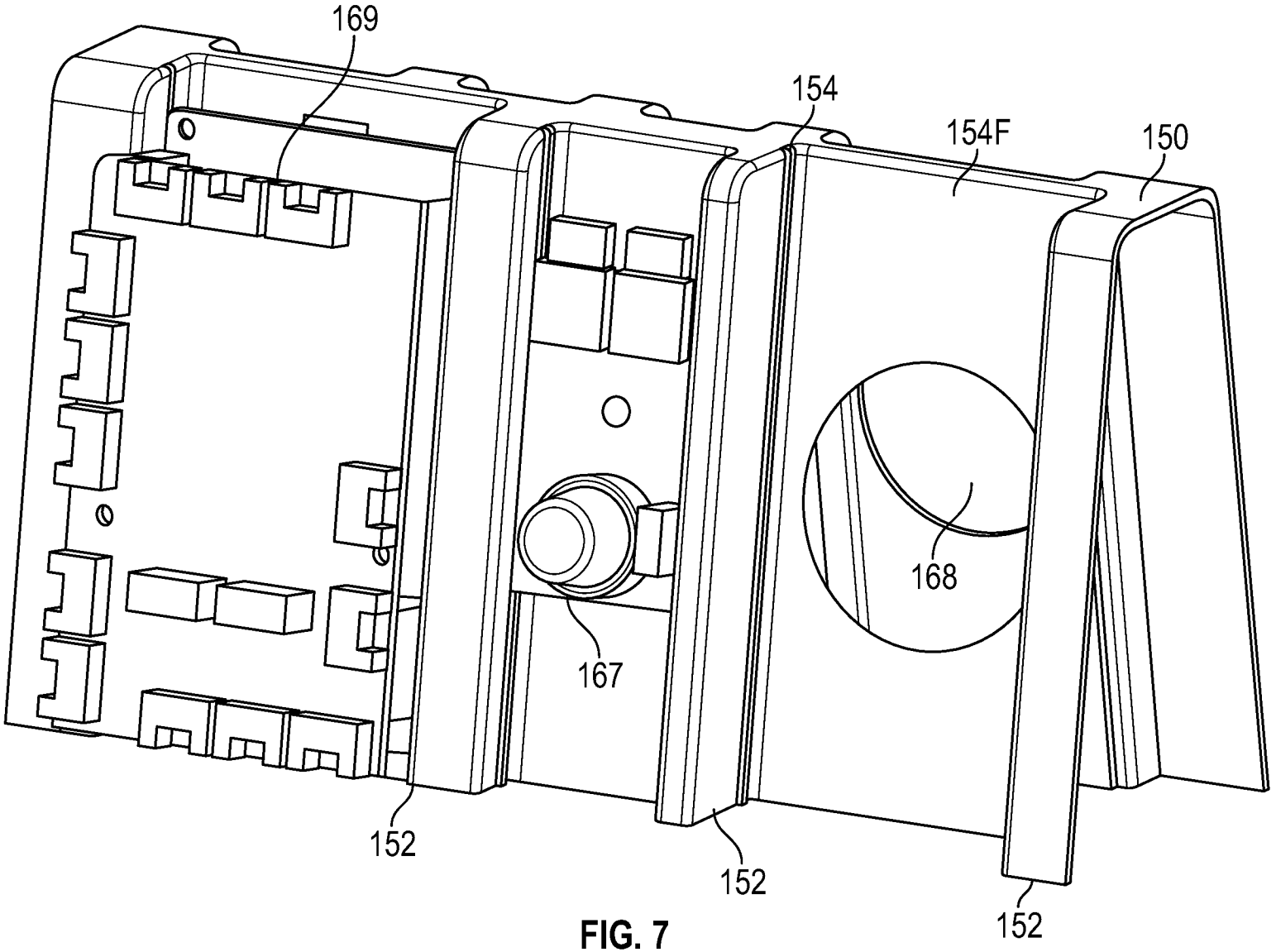
FIG. 7 is a top, front, left-side perspective view of a sensor mounting bridge for mounting a plurality of gas and climatic sensors within an interior chamber of the IAQ monitor of FIG. 1.
Figure 8:
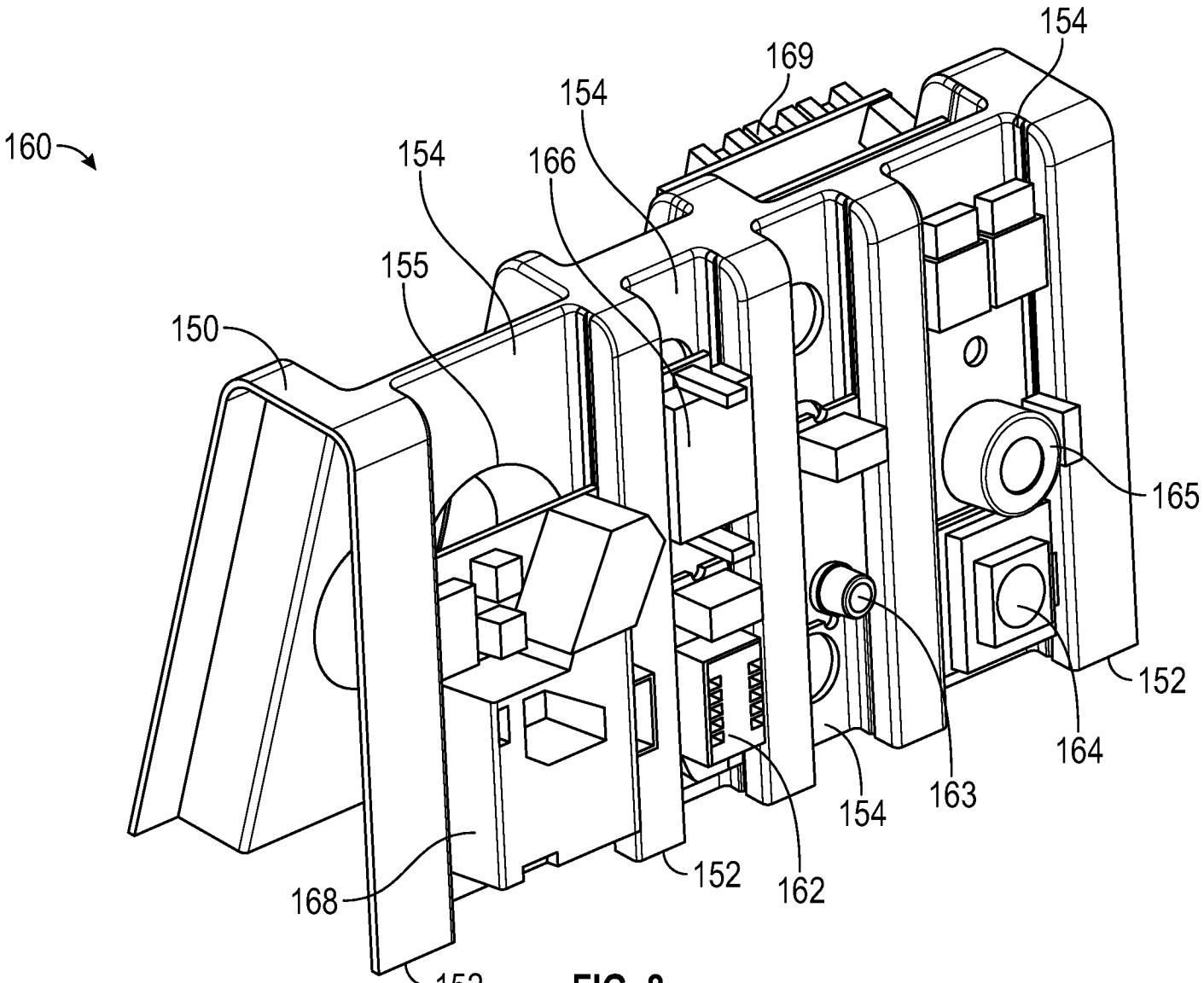
FIG. 8 is a top, rear, right-side perspective view of the sensor mounting bridge for mounting a plurality of gas and climatic sensors within an interior chamber of the IAQ monitor of FIG. 1.

Referring to FIGS. 7 and 8, the sensor mounting bridge 150 is illustratively shown with a plurality of sensors 160 (FIG. 8) mounted thereon to detect climatic and gaseous conditions of the airflow in the ductwork of the HVAC system. The plurality of sensors 160 illustratively include a temperature and relative humidity sensor 162, a total volatile organic compounds (TVOC) sensor 163, a formaldehyde ($CH_2O$) sensor 164, a carbon monoxide (CO) sensor 165, a carbon dioxide ($CO_2$) sensor, an ozone ($O_3$) sensor (FIG. 7), and a particulate matter (PM) sensor 168 (e.g., PM 2.5 particle sensor). The types and sensitivities of the sensors 160 mounted on the sensor mounting bridge 150 is not limiting and can vary depending upon local building and outside atmospheric conditions.

The sensor mounting bridge 150 is illustratively configured as a V-shaped support and includes a plurality of raised sidewalls 152 which for slots or channels 154 therebetween in which one or more sensors is mounted. The channels 154 channel the airflow to the sensors to enhance their detection capabilities of the airflow. The spacing between the sidewalls 152 forming the air flow channels 154 is dependent in part on the sensor being mounted therein. Although the sensor mounting bridge 150 is shown as having a V-shape configuration, such shape is not considered limiting. One or more perforations or orifices 155 can be provided through the channels 154 to further distribute the airflow around the sensors 160.

Preferably, a digital microprocessor 169 is also mounted in one of the channels 154 of the mounting bridge 150 to receive electrical signals from the sensors 160. The microprocessor 169 includes programming to determine whether a predetermined threshold associated with one or more sensors 160 has been exceeded, and send an output signal to a remotely located controller 204 for controlling the bi-polar ionizer 202 (see FIG. 1) and/or a damper, register or other airflow device in the HVAC system of the building. The microprocessor 169 can store data associated with various parameters and metrics associated with the airflow, e.g., timestamps, source of electronic sensor signals, destination of electronic signals sent, among any other operatives associated with the operation of the IAQ monitor 110.

Figure 9:
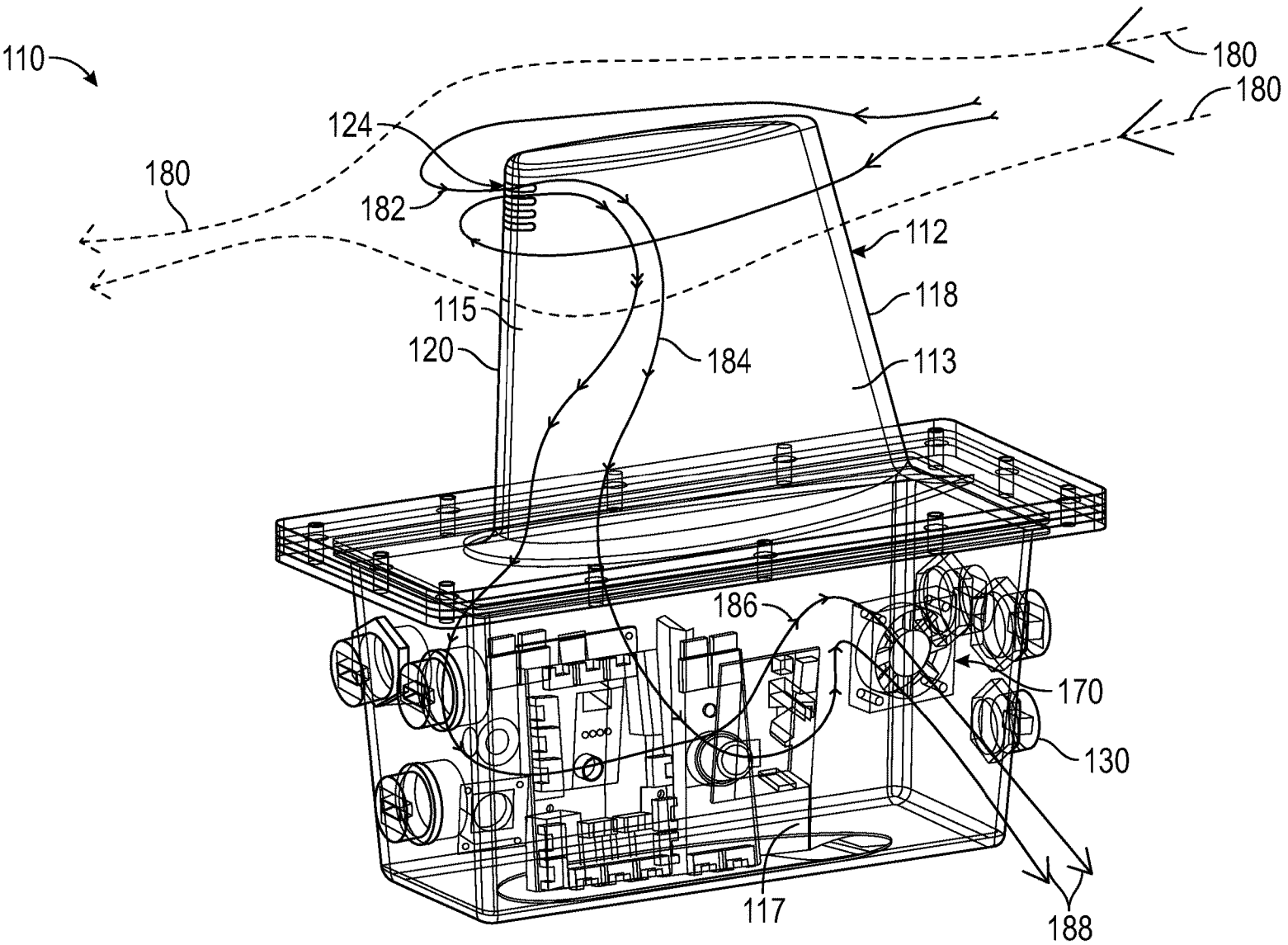
FIG. 9 is schematic view illustrating a flow of air through the IAQ monitor of FIG. 1.

Referring to FIGS. 2, 3 and 9 in conjunction with FIG. 7, an electric fan 170 is installed on the mounting bridge 150 to draw air into the inlet port 124, through the interior chamber 113 and out through the air output port 130. The electric fan 170 is preferably mounted adjacent the air outlet port 130, illustratively shown in the slot 154F of the mounting bridge 150 in FIG. 7, although such location is not considered limiting. For example, the electric fan 170 can be mounted in other areas of the interior chamber 113, such as within the upper interior channel portion 115 of the first housing section 112, e.g., in vicinity of the inlet port 124 or near the open bottom between the first and second housing sections 112, 114, among other locations within the interior chamber 113 of the housing 110. The electric fan 170 is controlled by one or more programs executed by the microprocessor 169 to control the rotational speed of the fan blades, and thereby control the rate of air flow into the interior chamber 113 and over the plurality of sensors 160. The rotational speed is controlled by adjusting the power supplied to the electric fan 170 from the electric power source 140 (FIG. 1). The fan assists in maintaining a constant and predetermined airflow to the various sensors.

Referring to FIGS. 2 and 3, the sensor mounting bridge 150 with the plurality of sensors 160 and microprocessor 169 mounted thereto are installed within the lower interior chamber 117 of the second housing section 114. Additionally, the power and communication ports 125-127 are also preferably mounted to the second housing section 114, although such location on the housing 111 is not considered limiting. The installation of the electronic components and sensors 160 in the second housing section 114 better enables access to such internal and external components from the outside of the ductwork at times where maintenance/troubleshooting of the IAQ monitor 110 is required.

Referring to FIG. 9, the IAQ monitor 110 is preferably installed within a return duct or air handler of the building's HVAC system in order to best sample the air quality in one or more rooms, and mitigate improper sample readings which may be caused by excessive or irregular air duct velocity, air dilution from outside air entering and mixing with the partially closed HVAC system, and stratification in the duct networks caused by bends, expansions, contractions and the like in the ductwork. The IAQ monitor 110 is a closed housing 110 with the exception of duct air flowing into the inlet port 124, through the interior chamber 113 of the housing 111, and being discharged via the outlet port 130.

More specifically, during operation, duct air from the HVAC system flows through the ductwork as indicated by arrows 180. The duct airflow in the return of the HVAC system flows past the leading edge 118, lateral sidewalls 116 and trailing end 120 of the first housing section 112. The aerodynamic shape of the first housing section 112 minimizes airflow disturbances within the ductwork. When the electric fan 170 is activated, it rotates at a predetermined rotational rate which is greater than the duct airflow rate, thereby creating a low pressure zone at the inlet port 124 and within the interior chamber 113. A portion of the duct air 182 enters the low pressure zone at the inlet port 124 and flows through the interior channel 115 of the first housing section 112 to the interior chamber portion 117 in the second housing section 114, as indicated by airflow paths 184 and 186. More specifically, the air flowing in the lower interior chamber portion 117 is directed over and past the plurality of sensors 160 via the plurality of channels or slots 154 formed between the vertically directed sidewalls 152, as discussed above with respect to FIGS. 7 and 8. The fan 170 then expels the air inside the interior chamber 113 out of the IAQ monitor 110 via the output port 130, as indicated by airflow path 188 in FIG. 9. Advantageously, positioning the sensors 160 within an interior chamber 113 of the housing 110, as opposed to the prior art in which the sensors were predominately mounted on or flush with the exterior surface of the monitor housing, reduces exposure to high concentrations of pollutants and contaminants within the HVAC system which, after prolonged exposure, can accumulate on the sensors and negatively affect the sensor detection capabilities. Accordingly, the present invention minimizes direct exposure to the pollutants and contaminants in the duct air stream, thereby increasing reliability and longevity of the IAQ monitor, as well as decreasing the frequency for cleaning and maintenance repairs.

Another advantage is the ability to control the flow rate of air into the IAQ monitor 110 so that the sensors can maintain their high sensitivity levels for prolonged periods to detect the quality of the air therethrough.

The IAQ monitor is configured to be certified by standard industry certification organizations, such as RESET™ which has developed a healthy building certification program based around continuous monitoring and maintenance.

The air purification system uses data collected by the IAQ monitor 110 to automatically adjust ion intensity levels of the bi-polar ionization unit 202 in response to changes in air quality to help maintain optimal ion saturation in the treated space for optimal air purification. The various climatic and gaseous conditions monitored trigger automatic adjustment of the bi-polar ionization unit 202 using feedback loops when programmed threshold values are exceeded.

Figure 10:
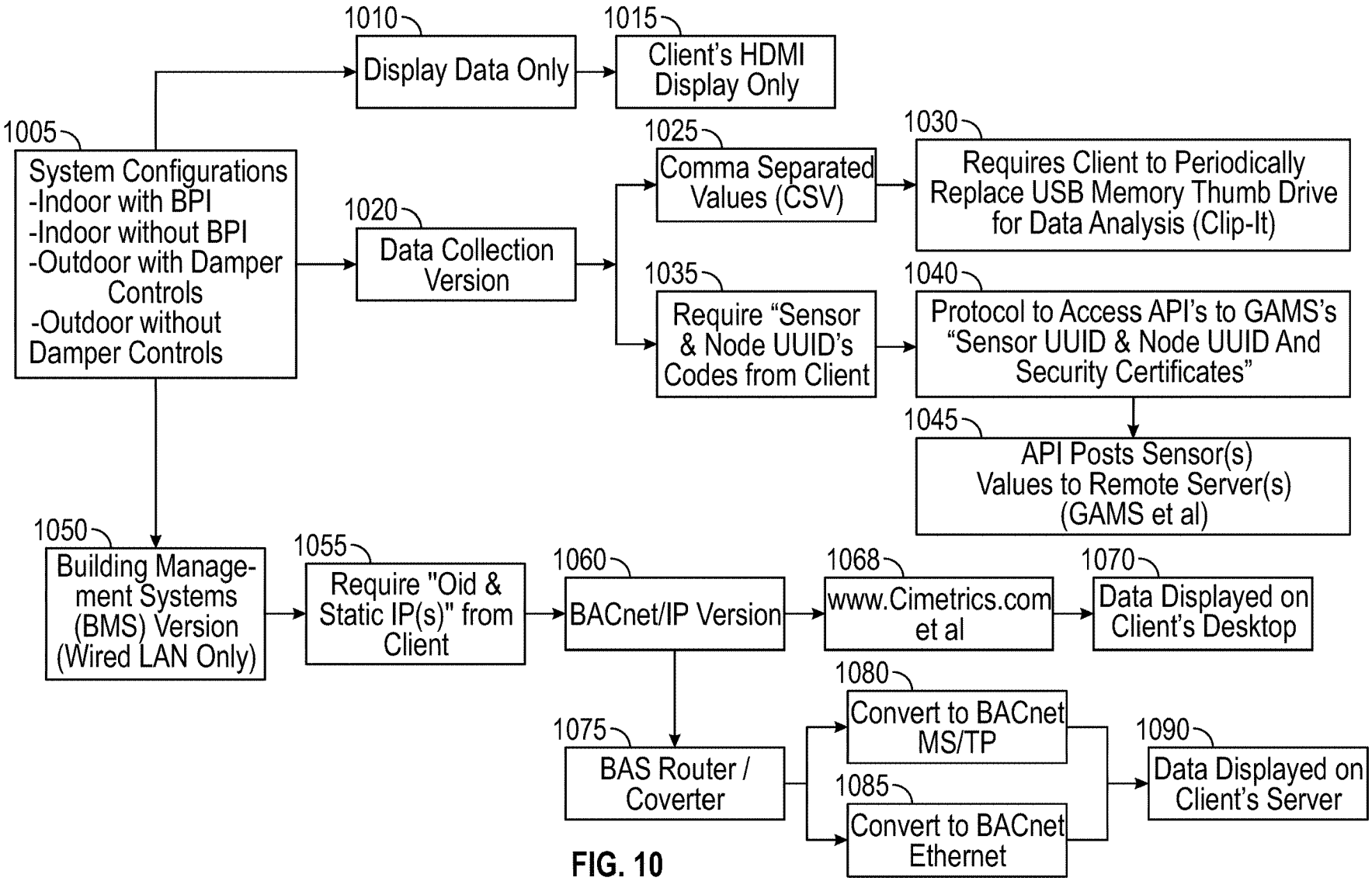
FIG. 10 illustrates IAQ monitor configurations for data display, data collection, and building management control.

FIG. 10 illustrates system configurations available for IAQ monitor 110 for data display, data collection, and building management system control. As box 1005 indicates, the IAQ monitor 110 can integrate for controlling indoor HVAC function with or without bi-polar ionization (BPI), and can integrate for HVAC systems with or without damper controls for outside air admission.

As box 1010 indicates, the IAQ monitor 110 can operate in a display mode only. In this mode, as shown in box 1015, a user's computer monitor is connected directly to IAQ monitor 110, via the HDMI connector 137 discussed previously.

As shown in box 1020, the IAQ monitor 110 can be used for data collection. One method is shown in boxes 1025 and 1030, where comma-separated values (CSV) are saved to a USB memory thumb drive, that can be periodically retrieved by a user. Another method is shown in boxes 1035-1045, where sensor and node universal unique identifier (UUID) codes are obtained from a user, and a proprietary API posts the IAQ monitor 110 sensor values to the user's remote server. The General Algebraic Modeling System (GAMS) is used for modeling the HVAC system for mathematical optimization.

As shown in boxes 1050-1090, the IAQ monitor 110 can be used with a building management system, via a wired electronic communication network, for example, using a BACnet/IP protocol over a local area network of the building. When used in this manner, the IAQ monitor 110 will use object identifiers (Oids), an identifier mechanism standardized by the International Telecommunications Union (ITU) and ISO/IEC for naming any object, concept, or thing with a globally unambiguous persistent name, and a static IP, ad address assigned by a network administrator for each device connected to the network. The BACnet/IP protocol can be configured with a BACnet protocol stack and metering, such as available through Cimetrics and other vendors.

Data from IAQ monitor 110 can be stored on a cloud server and made available to a user. Automatic alerts can also be sent based upon readings. The IAQ monitor 110 can also send regular analysis of the building air quality, together with a comparison to published IAQ standards and guidelines, as well as comparisons to similar buildings.

In an alternate embodiment, the sensors can be compartmentalized to help avoid cross interference between sensors.

In another alternate embodiment, NIST-certified sensors can be used, allowing for the IAQ monitor 110 to be used in place of conventional IAQ testing services or industrial hygiene testing, both of which are far more costly and which only provide a snapshot in time.

Although an exemplary description of the invention has been set forth above to enable those of ordinary skill in the art to make and use the invention, that description should not be construed to limit the invention, and various modifications and variations may be made to the description without departing from the scope of the invention, as will be understood by those with ordinary skill in the art, and the scope thereof is determined by the claims that follow.

What is claimed is:

1. An indoor air quality (IAQ) monitor device for detecting climatic and gaseous metrics in ductwork of an heating, ventilation and cooling (HVAC) system of a building, the IAQ monitor device comprising:

a housing including a first housing section defining a first interior portion and a second housing section defining a second interior portion, the first interior portion and the second interior portion together forming an interior chamber;

wherein the first housing section is shaped as a fin, being configured for insertion into the HVAC system ductwork of the building, and having a predetermined height, a leading edge, and a trailing edge, the leading edge and the trailing edge being adjoined by opposing curved sidewalls, wherein the trailing edge includes an air inlet port configured to introduce a portion of air from the ductwork into the interior chamber;

the second housing section being configured for mounting to an exterior surface of the ductwork and to the first housing section so as to secure the first housing section within the ductwork, wherein the housing further includes an air outlet port configured to discharge the portion of air from the interior chamber of the IAQ monitor device;

a plurality of sensors for detecting the climatic and gaseous metrics, the plurality of sensors being mounted on a support frame positioned within the second interior portion of the second housing section, the support frame having a plurality of channels, each channel configured for mounting one or more of the plurality of sensors, the plurality of channels being configured to channel air flow from the first interior portion of the first housing section to proximity of the plurality of sensors and for expulsion through the air outlet port of the IAQ monitor device; and electronic circuitry including an electric fan and one or more communication ports, the electric fan being configured to selectively control a flow rate of the portion of air from the ductwork through the housing via the air inlet port and the air outlet port, the one or more communication ports being in electronic communication with the plurality of sensors, said electronic circuitry configured to send electronic signals from the plurality of sensors to a controller of the HVAC system.

2. The IAQ monitor of claim 1, wherein the opposing curved sidewalls are symmetrical and convex in shape with respect to a central longitudinal axis of the first housing section.

3. The IAQ monitor of claim 1, wherein the leading edge of the first housing section is V-shaped and configured to interface with upstream airflow within the HVAC system ductwork.

4. The IAQ monitor of claim 1, wherein the trailing edge of the first housing section is U-shaped.

5. The IAQ monitor of claim 1, wherein the trailing edge of the first housing section is flat.

6. The IAQ monitor of claim 1, wherein the air outlet port is located within the second housing section, and wherein the electric fan is mounted within the interior chamber proximate the air outlet port.

7. The IAQ monitor of claim 6, wherein the electric fan operates at a predetermined rotational rate to draw duct air through the air inlet port and past the plurality of sensors at a predetermined flow rate.

8. The IAQ monitor of claim 7, wherein the electric fan is mounted on the support frame installed in the second housing section.

9. The IAQ monitor of claim 1, wherein the plurality of sensors include a particulate matter sensor, a carbon monoxide sensor and a carbon dioxide sensor.

10. The IAQ monitor of claim 1, wherein the plurality of sensors includes formaldehyde sensor.

11. The IAQ monitor of claim 1, wherein the plurality of sensors include a total volatile organic compound sensor.

12. The IAQ monitor of claim 1, wherein the plurality of sensors include a temperature sensor and a humidity sensor.

13. The IAQ monitor of claim 1, wherein the one or more communication ports include an Ethernet connector.

14. The IAQ monitor of claim 1, wherein the one or more communication ports include a USB port.

15. The IAQ monitor of claim 1, wherein the one or more communication ports include an HDMI connector.

16. The IAQ monitor of claim 1, wherein the one or more communication ports include a power input connector for receiving power from an external source.

17. The IAQ monitor of claim 1, wherein the support frame provided within the second housing section is a V-shaped support frame.

18. The IAQ monitor of claim 17, wherein each leg of the V-shaped support frame includes at least one channel configured to direct airflow in the proximity of the plurality of sensors mounted therein.

* * * * *